United States Patent [19]

Schubert et al.

[11] Patent Number: 4,532,977

[45] Date of Patent: Aug. 6, 1985

[54] CONTINUOUS CASTING INSTALLATION

[75] Inventors: Hermann Schubert, Linz, Austria; Max Ahrens; Manfred Haissig, both of Irvine, Calif.

[73] Assignee: Voest-Alpine Aktiengesellschaft, Linz, Austria

[21] Appl. No.: 434,620

[22] Filed: Oct. 15, 1982

[30] Foreign Application Priority Data

Oct. 16, 1981 [AT] Austria ..... 4453/81

[51] Int. Cl.[3] ..... B22D 11/00

[52] U.S. Cl. ..... 164/442; 164/448

[58] Field of Search ..... 164/440, 490, 441, 442, 164/447, 448

[56] References Cited

U.S. PATENT DOCUMENTS

| | | | |
|---|---|---|---|
| 2,284,704 | 6/1942 | Welblund et al. | 164/442 |
| 3,015,862 | 1/1962 | Rustemeyer et al. | 164/441 |
| 3,174,320 | 3/1965 | Greuel | 72/251 |

FOREIGN PATENT DOCUMENTS

| | | | |
|---|---|---|---|
| 915381 | 11/1972 | Canada | 164/440 |
| 3048483 | 7/1982 | Fed. Rep. of Germany | 164/440 |
| 860785 | 6/1976 | Japan | 164/441 |
| 0048930 | 5/1978 | Japan | 164/440 |
| 129303 | of 1960 | U.S.S.R. | 164/442 |

*Primary Examiner*—Nicholas P. Godici
*Attorney, Agent, or Firm*—Brumbaugh, Graves, Donohue & Raymond

[57] ABSTRACT

An improved take-off device for a horizontal continuous-casting installation is provided. The arrangement comprises a frame and a mounting seated on rollers in the frame. The mounting is rotatable relative to the frame and supports the drive roll and its drive shaft, and a counter-pressure roll, which rolls preferably have counter-profiles corresponding to the cross section of the casting. The mounting comprises two concentrically arranged tubes which are sealed at their ends, thereby defining a cooling area therein. The adverse effects of gravity on casting quality may be mitigated by rotating the mounting relative to the frame, and locking it as a desired relative position, depending upon the cross-sectional configuration of the casting.

7 Claims, 2 Drawing Figures

CONTINUOUS CASTING INSTALLATION

BACKGROUND OF THE INVENTION

The invention relates to a continuous-casting installation, and more particularly, to a horizontal continuous-casting installation having a take-off device supported upon a frame. The device comprises at least one drive-roll adapted to be driven by a motor and at least one counter-pressure roll adapted to be pressed against the drive-roll by a press-down device, the axes of said rolls preferably running parallel.

In a known continuous-casting installation, the shaft of a drive-roll runs horizontally, and is mounted directly in a frame. A counter-pressure roll is adapted to be moved towards and away from the shaft of the drive-roll by means of a press-down device held in the frame.

It has been found that the arrangement of the rolls described above, especially in the case of castings having large square or rectangular cross-sections (e.g. in excess of 25 $cm^2$), results in gravity having a disturbing effect upon the quality of the casting. In addition, it has been found that cooling conditions are highly unsatisfactory at the take-off of a cross-sectionally rectangular casting when a surface lies in a horizontal plane. These unsatisfactory results include a poor pattern of solidification of the interior of the casting, leading to differences in structure over the cross-section of the casting, and to the formation of increased segregation.

SUMMARY OF THE INVENTION

It is the purpose of the invention to provide a continuous-casting installation of the type which will permit optimal take-off of castings of different cross-sections under particularly favorable metallurgical conditions.

It is therefore proposed, according to the invention, that the drive-roll(s) or the drive-shaft(s) thereof, the press-down device(s), and the counter-pressure roll(s) be held in a mounting resting in a frame. The mounting is adapted to be rotated relative to the frame about the longitudinal axis of the casting, and to be locked in a selected position. Thus, it is possible to take-off a casting, for example, one having a square or rectangular cross-section, in a position in which a diagonal of the cross-section runs vertically, whereas for the take-off of cross-sectionally circular castings, the shaft of the drive-roll can be set to a horizontal position. This makes it possible to arrange the take-off of the casting so that the incompletely solidified casting exhibits optimal rigidity.

According to the invention, the drive-roll(s) and, if necessary, the counter-pressure roll(s) have a counter-profile corresponding to the profile of the casting. This is a particularly simple way of achieving exact guidance, even in the case of a casting coated with scale.

According to another characteristic of the invention, the rotating and lockable mounting comprises at least two opposing support-and guide-rolls. This ensures accurate guidance and take-off, even in the case of heavy castings.

According to still another characteristic of the invention, the mounting is adapted to be locked in specific positions by means of one or more bolts adapted to be inserted into openings in an adjusting ring secured to the frame. This provides a very simple design for a particularly accurate locking device.

In one very simple design, the mounting is in the form of a cylinder resting upon rollers mounted in the frame. At least one of the rollers, preferably, is adapted to be driven. This provides a very simple means for rotating the take-off device.

In a particularly preferred embodiment of the invention, the mounting is in the form of a double casing, comprising two concentrically arranged tubes the ends of which are sealed by end-rings. Feed and return lines for a coolant are provided. The drive for the drive-roll, and the press-down device for the counter-pressure roll, preferably are arranged on the outside of the mounting. This arrangement largely protects the drive for the drive-roll and the press-down devices from the heat radiated from the casting during the take-off operation. This is beneficial because the drive usually comprises a relatively sensitive electronic control. The result is a substantially simpler design, and a reduced need for overhauls. At the same time, additional cooling of the already cooled take-off rolls and of the axles is obtained.

BRIEF DESCRIPTION OF THE DRAWINGS

For a better understanding of the present invention, the scope of which will be pointed out in the appended claims, reference is made to the following detailed description of an exemplary embodiment in conjunction with the accompanying drawings, in which:

DESCRIPTION OF EXEMPLARY EMBODIMENT

Figure 1:
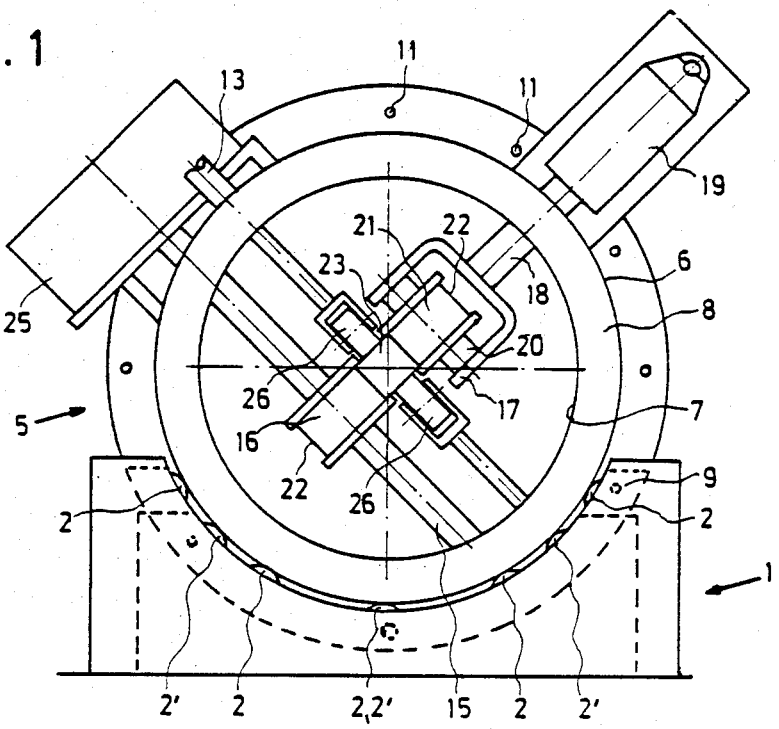
FIG. 1 is a side elevational view of a take-off device in accordance with the present invention.
Figure 2:
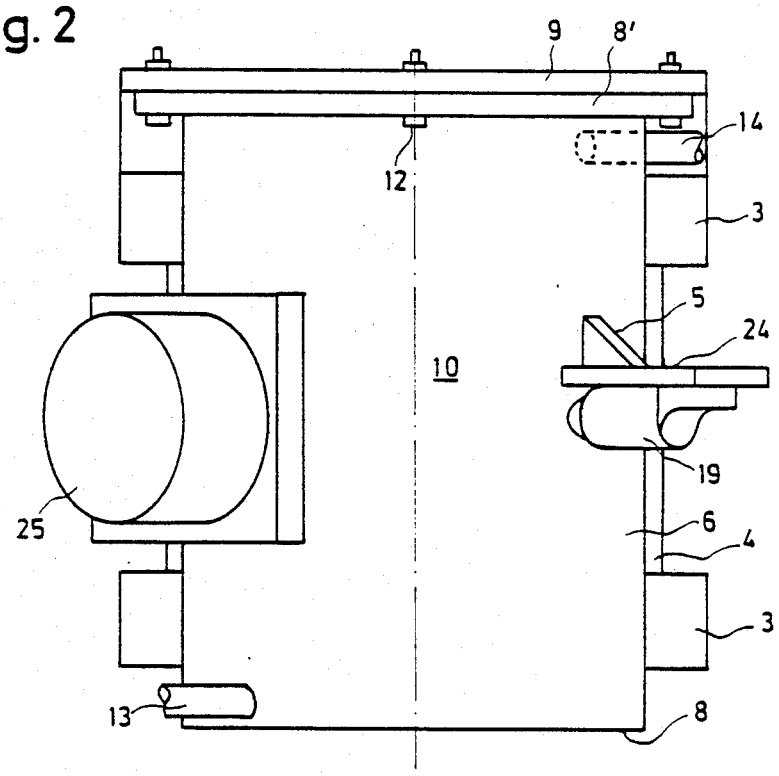
FIG. 2 is a plan view of the take-off device illustrated in FIG. 1.

Referring to the figures, rollers 2, 2' are mounted in a frame 1. The rollers 2 (five in the illustrative embodiment) are arranged only in raised edge-areas 3 of the frame. The rollers 2' (three in the illustrative embodiment) are arranged in a central area 4 of the frame 1 (as shown by the dotted lines in FIG. 1), and lower than the raised edge-areas 3. The raised edge-areas 3 also are wider than the central area 4.

Located in the central area 4 is a mounting 5 which rests upon the three rollers 2'. The mounting 5 also rests upon the five rollers 2, at least one of which is adapted to be driven, in the raised edge-area 3 of the frame 1.

The mounting 5 comprises two concentric tubes 6, 7 sealed at their ends by end rings 8, 8' and forming a cooling area 10 therein. The end-ring 8' projects beyond the outer tube 6 and forms a flange. Arranged in this flange, and in the part of the frame 1 serving as an adjusting ring 9, are openings 11 which are aligned with each other at specific angular positions of the two flanges, thus making it possible to secure the mounting 5 relative to the frame 1 in a selected position by the insertion of bolts 12 or the like.

Two pipes 13, 14 pass substantially radially through the outer tube 6 of the mounting 5, providing feed and return lines (via hoses not illustrated) for a suitable coolant flowing through the interior of the cooling area 10 defined by the tubes 6, 7 and end-rings 8, 8'.

Mounted in the mounting 5 is a shaft 15 which is secured to a drive-roll 16 and which runs along a chord of the concentric tubes 6, 7. The bearings for the shaft 15 may be arranged in blocks welded sealingly to the tubes 6, 7. Also projecting into the interior of the mounting 5 is a piston-rod 18 carrying a forked head 17 of a press-down device 19 which comprises a pistoncylinder arrangement. The head 17 of the piston-rod 18, which passes radially through the tubes 6, 7, has an axis 20 which is parallel to the shaft 15, and carries a counter-pressure roll 21.

The surfaces of the drive-roll 16 and counter-pressure-roll 21 are provided with peripheral grooves 22 corresponding to the profile of a casting 23 to be taken off.

The press-down device 19 is arranged on a bracket 24 which is secured to the outside of the tube 6 of the mounting 5, and is thus shielded from the heat radiated by the casting 23 by the coolant flowing through the mounting 5. Adjustable support-and guide-rolls 26 also are arranged in the mounting 5.

Because the central area 4 of the frame 1 is lower and narrower than the raised edge-areas 3, sufficient room is available to pivot the mounting 5 through 45° in both directions from the position shown in FIG. 1. Furthermore, the raised edge-areas 3 provide a satisfactory and highly stable mounting for the mounting 5.

The position of the mounting 5 shown in the drawing is particularly suitable for castings of square cross-section, because in this position the effect of gravity upon the casting during take-off can be controlled particularly well, and all surfaces of the casting are cooled substantially uniformly.

In contrast to this, in the case of castings having a circular cross-section, it is more advantageous for the drive-roll shaft 15 to run horizontally below the casting. This is easily arrived at by removing the bolts 12, rotating the mounting 5, through 45° in the counter-clockwise direction from the position as illustrated in FIG. 1, and reinserting the bolts 12 in this new setting. Rotation of the mounting 5 may be accomplished by means of drivable rollers 2, 2' or by some other means, such as cylinder-piston units engaging the frame 1 and the mounting 5.

It is obviously also possible to construct the frame 1 in two parts, leaving enough space therebetween to allow a drive 25, or a press-down device 19, to be swung into the space. Such arrangement would permit the mounting 5 to rotate up to 360°, as long as the feeds to the pipes 13, 14, the press-down device 19, and the drive 25 are designed accordingly.

It will be appreciated by those skilled in the art that variations and modifications may be made without departing from the spirit of the inventive concepts disclosed herein. All such variations and modifications are intended to fall within the scope of the appended claims.

We claim:

1. In a horizontal continuous-casting installation comprising a take-off device for a casting having a longitudinal axis, said take-off device being supported on a frame and including at least one drive roll having an axis and being secured to a drive shaft, said at least one drive roll being adapted to be driven by a motor means, and at least one counter-pressure roll having an axis and an associated press-down device, said counter-pressure roll being adapted to be urged toward said drive roll by said press-down device, preferably said axis of said at least one drive roll and said axis of said at least one counter-pressure roll being parallel, the improvement wherein, said take-off device further comprises a mounting for supporting said drive shaft, said at least one drive roll, said at least one counter-pressure roll and said press-down device, said mounting being supported relative to said frame for rotation about said longitudinal axis of said casting, and wherein there are further provided cooperating means on said mounting and said frame for enabling selective locking of said mounting in any one of a plurality of predetermined positions relative to said frame.

2. The horizontal continuous-casting installation according to claim 1, wherein at least one of said at least one drive roll and said at least one counter-pressure roll have a counter-profile corresponding to the profile of said casting.

3. The horizontal continuous-casting installation according to claim 1 or 2, wherein said rotatable mounting further comprises at least two oppositely arranged supporting and guiding rolls.

4. The horizontal continuous-casting installation of claim 3, wherein said frame further comprises rollers mounted in said frame, at least one of said rollers being adapted to be driven, and wherein said mounting comprises a cylinder resting upon said rollers.

5. In a horizontal continuous-casting installation comprising a take-off device for a casting having a longitudinal axis, said take-off device being supported on a frame and comprising at least one drive roll having an axis and being secured to a drive shaft, said at least one drive roll being adapted to be driven by a motor means, and at least one counter-pressure roll having an axis and an associated press-down device, said counter-pressure roll being adapted to be urged toward said drive roll by said press-down device, preferably said axis of said at least one drive roll and said axis of said at least one counter-pressure roll being parallel, the improvement wherein, said take-off device further comprises a mounting supporting said drive shaft, said at least one drive roll, said at least one counter-pressure roll and said press-down device, and said frame includes an adjusting ring having a plurality of holes, said mounting being supported by and rotatable relative to said frame about said longitudinal axis of said casting and comprising (i) a flange having a plurality of holes corresponding to the plurality of holes in said adjusting ring, and (ii) locking means comprising bolts adapted to be inserted in said holes of said adjusting ring and said flange for locking said mounting in a selected position relative to said frame.

6. The horizontal continuous-casting installation according to claim 5, wherein said drive for said drive roll and said press-down device for said counter-pressure roll are supported on the exterior of said mounting.

7. In a horizontal continuous-casting installation comprising a take-off device for a casting having a longitudinal axis, said take-off device being supported on a frame and comprising at least one drive roll having an axis and being secured to a drive shaft, said at least one drive roll being adapted to be driven by a motor means, and at least one counter-pressure roll having an axis and an associated press-down device, said counter-pressure roll being adapted to be urged toward said drive roll by said press-down device, preferably said axis of said at least one drive roll and said axis of said at least one counter-pressure roll being parallel, the improvement wherein, said frame comprises rollers mounted in said frame, means for driving at least one of said rollers and wherein said take-off device comprises a cylindrical mounting resting on said rollers and supporting said drive shaft, said at least one drive roll, said at least one counter-pressure roll and said press-down device, and wherein said cylindrical mounting comprises (i) two concentrically arranged tubes, (ii) end rings adapted to seal the ends of said two concentric tubes to thereby define a cooling area therebetween, (iii) a feed line and a return line for a coolant to flow through said cooling area, and (iv) at least two oppositely arranged supporting and guiding rolls, said cylindrical mounting being rotatable relative to said frame about said longitudinal axis of said casting, the improvement further comprising locking means for locking said mounting in a selected position relative to said frame.

* * * * *

UNITED STATES PATENT AND TRADEMARK OFFICE

CERTIFICATE OF CORRECTION

PATENT NO. : 4,532,977

DATED : Aug. 6, 1985

INVENTOR(S) : Schubert et al.

It is certified that error appears in the above-identified patent and that said Letters Patent is hereby corrected as shown below:

First page, Item 73, add --and Vereinigte Edelstahlwerke Aktiengesellschaft, Vienna, Austria--.

First page, penultimate line of ABSTRACT, "as" should read --at--

Col. 1, line 60, "support-and" should read --support- and--; and

Col. 3, line 13, "support-and" should read --support- and--.

Signed and Sealed this

*Twenty-fifth* Day of *February 1986*

[SEAL]

*Attest:*

DONALD J. QUIGG

*Attesting Officer*

*Commissioner of Patents and Trademarks*